US008985165B2

(12) United States Patent
Wegman et al.

(10) Patent No.: US 8,985,165 B2
(45) Date of Patent: Mar. 24, 2015

(54) APPARATUS, METHOD AND SYSTEM FOR CARRYING AND DISPENSING AN INK USEFUL IN PRINTING

(75) Inventors: Paul M. Wegman, Pittsford, NY (US); Kevin L. Maltzahn, Webster, NY (US); Ricardo H. Mendoza, Webster, NY (US); Mark R. Vannicola, Rochester, NY (US); Wayne D. Drinkwater, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 278 days.

(21) Appl. No.: 13/428,797

(22) Filed: Mar. 23, 2012

(65) Prior Publication Data

US 2013/0249978 A1 Sep. 26, 2013

(51) Int. Cl.
*B41J 29/38* (2006.01)
*B41J 2/175* (2006.01)

(52) U.S. Cl.
CPC ..... *B41J 2/175* (2013.01); *B41J 2/17503* (2013.01); *B41J 2/17513* (2013.01); *B41J 2/17523* (2013.01); *B41J 2/17533* (2013.01); *B41J 2/17546* (2013.01); *B41J 2/17553* (2013.01)
USPC ..... 141/346; 347/6

(58) Field of Classification Search
CPC ..... B41J 29/38; B41J 2/175
USPC ..... 141/18, 83, 94, 95, 98, 329, 330, 346, 141/347, 348; 347/6, 85, 86
See application file for complete search history.

(56) References Cited

U.S. PATENT DOCUMENTS

| | | | | |
|---|---|---|---|---|
| 5,777,647 | A * | 7/1998 | Pawlowski et al. | 347/86 |
| 6,010,210 | A * | 1/2000 | Wilson et al. | 347/85 |
| 6,082,852 | A * | 7/2000 | Soga et al. | 347/86 |
| 7,275,810 | B2 * | 10/2007 | Shinada et al. | 347/50 |
| 7,325,909 | B2 * | 2/2008 | Yuen | 347/85 |
| D669,118 | S * | 10/2012 | Wegman et al. | D18/43 |
| 8,443,853 | B2 * | 5/2013 | Sarnoff et al. | 141/330 |
| 2001/0052370 | A1 * | 12/2001 | Shinada et al. | 141/2 |
| 2002/0001009 | A1 * | 1/2002 | Gasvoda et al. | 347/19 |
| 2002/0055167 | A1 * | 5/2002 | Pourahmadi et al. | 435/287.2 |
| 2002/0109761 | A1 * | 8/2002 | Shimizu et al. | 347/86 |
| 2003/0085968 | A1 * | 5/2003 | Shimizu et al. | 347/86 |
| 2003/0137568 | A1 * | 7/2003 | Shinada et al. | 347/86 |
| 2003/0234844 | A1 * | 12/2003 | Yamamoto et al. | 347/86 |

(Continued)

FOREIGN PATENT DOCUMENTS

EP 0463658 A1 * 5/1991 ..... B65D 35/52

*Primary Examiner* — Timothy L Maust
*Assistant Examiner* — Andrew Schmid
(74) *Attorney, Agent, or Firm* — Ronald E. Prass, Jr.; Prass LLP

(57) ABSTRACT

An apparatus, method and system are provided for carrying and dispensing an ink into a printing system. A system configured to dispense an ink comprises an ink carrying apparatus having a container, a movable cover, a unit monitor, a film, and a locking tab. The system also comprises a docking station configured to accept the ink carrying apparatus and engage the locking tab when the movable cover is in an open position. The system further comprises a processor configured to communicate with the unit monitor to facilitate a movement of the movable cover from a closed position to the open position. Based on a detection of a type of ink in the container, the movable cover is allowed to be moved from the closed position to the open position so as to facilitate removal of the film and cause the ink to be dispensed.

2 Claims, 4 Drawing Sheets

(56) References Cited

U.S. PATENT DOCUMENTS

| | | | | |
|---|---|---|---|---|
| 2004/0012657 | A1* | 1/2004 | Perkins et al. | 347/86 |
| 2004/0021751 | A1* | 2/2004 | Steinmetz et al. | 347/86 |
| 2004/0100540 | A1* | 5/2004 | Hatasa et al. | 347/86 |
| 2004/0135829 | A1* | 7/2004 | Yoshida | 347/7 |
| 2004/0160496 | A1* | 8/2004 | Tsurui et al. | 347/86 |
| 2005/0151802 | A1* | 7/2005 | Neese et al. | 347/85 |
| 2006/0139420 | A1* | 6/2006 | Muranaka et al. | 347/86 |
| 2006/0170741 | A1* | 8/2006 | Lee et al. | 347/86 |
| 2006/0290752 | A1* | 12/2006 | Okamoto et al. | 347/85 |
| 2007/0070156 | A1* | 3/2007 | Steinmetz et al. | 347/86 |
| 2007/0146452 | A1* | 6/2007 | Rodriguez et al. | 347/99 |
| 2007/0200904 | A1* | 8/2007 | Wilson et al. | 347/85 |
| 2008/0049083 | A1* | 2/2008 | Ishizawa et al. | 347/86 |
| 2008/0151018 | A1* | 6/2008 | Aoki et al. | 347/86 |
| 2008/0165232 | A1* | 7/2008 | Yuen | 347/86 |
| 2010/0231664 | A1* | 9/2010 | Steinmetz et al. | 347/86 |
| 2011/0142498 | A1* | 6/2011 | Wegman et al. | 399/262 |
| 2011/0279588 | A1* | 11/2011 | Fascio | 347/86 |
| 2013/0120510 | A1* | 5/2013 | Zaba et al. | 347/86 |
| 2013/0249978 | A1* | 9/2013 | Wegman et al. | 347/6 |

* cited by examiner

APPARATUS, METHOD AND SYSTEM FOR CARRYING AND DISPENSING AN INK USEFUL IN PRINTING

FIELD OF DISCLOSURE

The disclosure relates to an apparatus, method and system for carrying and dispensing an ink useful in printing.

BACKGROUND

Conventional high volume print systems often have large barrels for storing inks that are to be used in various printing processes. These barrels typically are specific with regard to the types or colors of inks that are contained within them. Operator errors may occur such as dispensing an incorrect ink type and/or color into a particular barrel because conventional containers for various inks are simple in design and do not communicate with the print system to prevent such operator errors.

SUMMARY

Therefore, there is a need for an ink carrier configured to communicate with a print system to control whether an ink contained by the ink carrier is dispensed into the print system.

According to one embodiment, an apparatus configured to carry and dispense an ink useful in printing comprises a container that comprises a bottom surface, an opening distal the bottom surface, and one or more sidewalls proximate the bottom surface, the one or more sidewalls being configured to form a neck portion positioned between the bottom surface, and a flange arranged about the opening. The apparatus also comprises a movable cover configured to mate with the flange so as to cover the opening in a closed position. The apparatus further comprises a unit monitor configured to facilitate a movement of the movable cover from the closed position to an open position. The apparatus additionally comprises a film positioned between one or more surfaces of the movable cover and one or more surfaces of the flange to seal the opening, the film being removable when the movable cover is in the open position. The apparatus also comprises a locking tab configured to restrict movement of the container when the movable cover is in the open position.

According to another embodiment, a method for dispensing an ink into a printing system comprises determining an installation of an ink carrying apparatus at a docking station. The ink carrying apparatus comprises a container that comprises a bottom surface, an opening distal the bottom surface, and one or more sidewalls proximate the bottom surface, the one or more sidewalls being configured to form a neck portion positioned between the bottom surface, and a flange arranged about the opening. The ink carrying apparatus also comprises a movable cover configured to mate with the flange so as to cover the opening in a closed position. The ink carrying apparatus further comprises a unit monitor configured to facilitate a movement of the movable cover from the closed position to an open position. The ink carrying apparatus additionally comprises a film positioned between one or more surfaces of the movable cover and one or more surfaces of the flange to seal the opening, the film being removable when the movable cover is in the open position. The ink carrying apparatus further comprises a locking tab configured to restrict movement of the container when the movable cover is in the open position.

The method also comprises causing, at least in part, a detection of a type of ink in the container based, at least in part, on a communication between a printing system affiliated with the docking station and the unit monitor. The method further comprises processing the detection of the type of ink to cause, at least in part, a permission to dispense the ink into the printing system. The method additionally comprises causing, at least in part, the movable cover to be moved from the closed position to the open position based, at least in part, on the permission. The method also comprises causing, at least in part, the container to be fixed to the docking station when the movable cover is in the open position by way of an interaction between the locking tab and the docking station. The method further comprises causing, at least in part, the film to be removed when the movable cover is in the open position to cause the ink to be dispensed into the printing system.

According to another embodiment, a system useful in printing configured to dispense an ink comprises an ink carrying apparatus. The ink carrying apparatus comprises a container that comprises a bottom surface, an opening distal the bottom surface, and one or more sidewalls proximate the bottom surface, the one or more sidewalls being configured to form a neck portion positioned between the bottom surface, and a flange arranged about the opening. The ink carrying apparatus also comprises a movable cover configured to mate with the flange so as to cover the opening in a closed position. The ink carrying apparatus further comprises a unit monitor configured to facilitate a movement of the movable cover from the closed position to an open position. The ink carrying apparatus additionally comprises a film positioned between one or more surfaces of the movable cover and one or more surfaces of the flange to seal the opening, the film being removable when the movable cover is in the open position. The ink carrying apparatus further comprises a locking tab configured to restrict movement of the container when the movable cover is in the open position.

The system also comprises a docking station configured to accept the ink carrying apparatus and engage the locking tab when the movable cover is in the open position. The system further comprises a processor configured to communicate with the unit monitor to facilitate the movement of the movable cover from the closed position to the open position. Based on a detection of a type of ink in the container that is based, at least in part, on a communication between the processor and the unit monitor, the movable cover is allowed to be moved from the closed position to the open position to facilitate removal of the film and cause the ink to be dispensed.

According to one example embodiment, An apparatus configured to carry and dispense an ink useful in printing comprises a container comprising a bottom surface, an opening distal the bottom surface, and one or more sidewalls proximate the bottom surface, the one or more sidewalls being configured to form a neck portion positioned between the bottom surface, and a flange arranged about the opening. The apparatus also comprises a cover configured to cover the opening in a closed position. The apparatus further comprises a unit monitor configured to facilitate a dispensing of the ink from the container.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Figure 1:
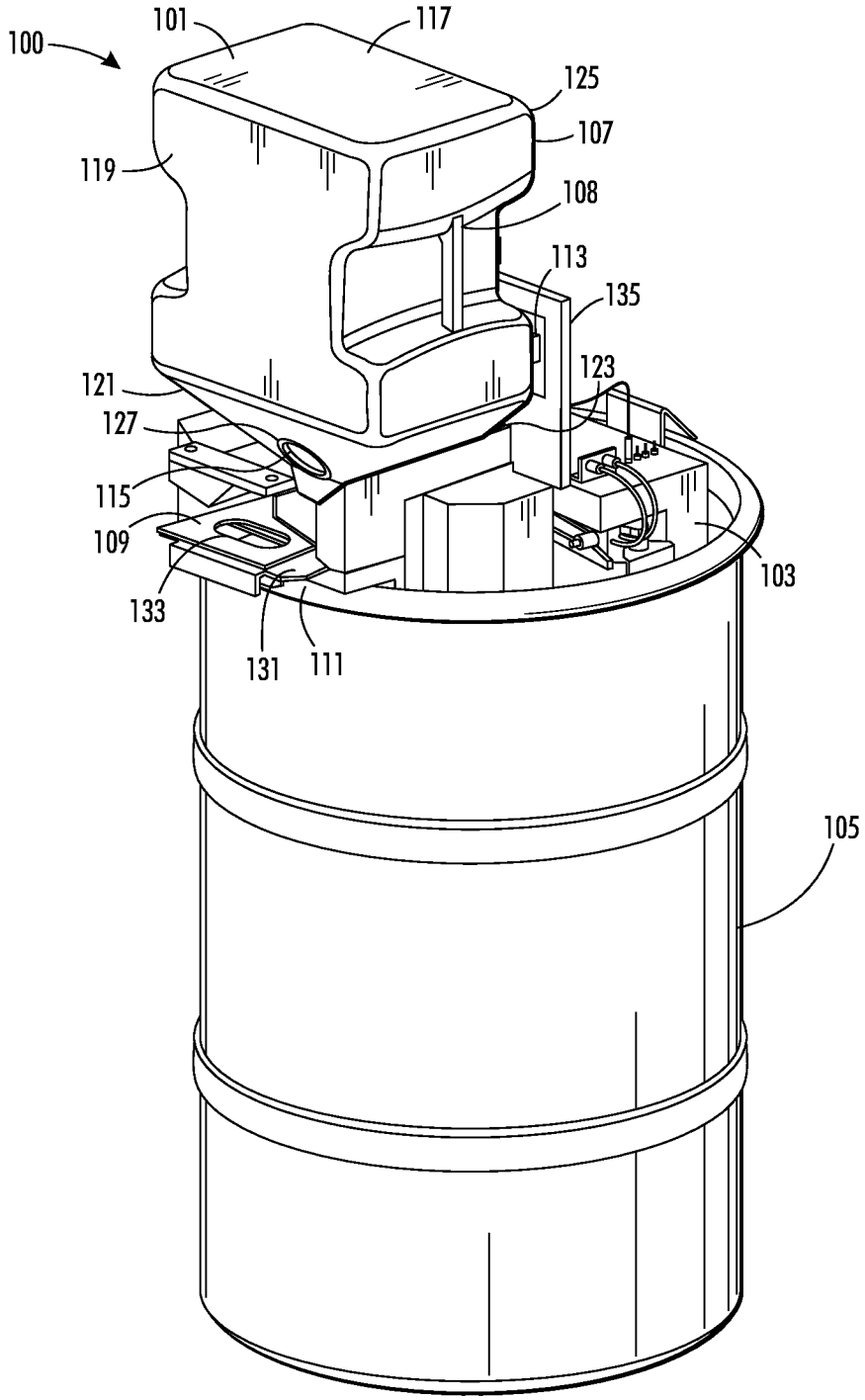
FIG. 1 is a diagram of a system configured for selectively dispensing an ink useful in printing, according to one embodiment.

Exemplary embodiments are intended to cover all alternatives, modifications and equivalents as may be included within the spirit and scope of the apparatuses, methods and systems as described herein.

Reference is made to the drawings to accommodate understanding of disclosed apparatuses, methods and systems useful in printing. In the drawings, like reference numerals are used throughout to designate similar or identical elements. The drawings depict various embodiments related to embodiments of illustrative apparatuses, methods and systems for selectively dispensing an ink useful in printing.

As used herein, the term "facilitating," or any variation thereof refers to any processing, action, and/or provision of data, for example, that causes, enables or helps an action to occur.

Conventional high volume print systems often have large barrels for storing inks that are to be used in various printing processes. These print systems often have numerous barrels that are specific with regard to the types or colors of inks that are contained within them. For example, one barrel may be designated to be a magenta ink source for the print system while another barrel may be a black ink source. Operator errors may occur such as dispensing an incorrect ink type and/or color into a particular barrel because conventional containers for various inks are simple in design and do not communicate with the print system to prevent such operator errors.

To address this problem, a system 100 of FIG. 1 introduces the capability to selectively dispense an ink useful in printing. Inks that may be dispensed into a printing system may include, for example, ink pellets, fluids, etc. Regardless of type, inks may need to be protected from moisture and other environmental affects until the ink is needed to replenish the barrel or other reservoir.

The system 100 comprises an ink carrier 101, a docking station 103, and a barrel 105. The ink carrier 101 has a container 107, a film seal 109, a slide cover 111 (slide cover 111 is not visible in FIG. 1, but is positioned beneath the film seal 109 and a lockable handle 131 that is part of the docking station 103), a unit monitor 113, and a plug 115. The docking station 103 includes the lockable handle 131, a receiving portion 123, and an antenna 135.

According to various embodiments, the system 100 is a green concept in that it enables commonality of ink carriers 101 between colors. Once used, the ink carrier 101 may be recycled so that it can be refilled and reused using the same or different type and/or color ink. As will be discussed in more detail below, the ink carrier 101 is a "smart bottle" that will only dispense its contents into a barrel 105 that has a corresponding type and/or color ink requirement. Additionally, the system 100 provides for selective distribution of ink, for example, at a determined time when it is needed.

According to various embodiments, the components of the ink carrier 101 such as the container 107 may, for example, comprise any lightweight polymer, metal, other material, or any combination thereof, and a static-resistant resin to facilitate as near complete dispensing of the ink contained within the ink carrier 101 as possible. Additionally, the ink carrier 101 is lightweight, on the order of about 10 kg when loaded with ink, for example, but depending on size and materials, the weight of the ink carrier 101 may vary.

In one or more embodiments, the container 107 may be blow molded, compression molded, injection molded, or any combination thereof in one or more steps to form the container 107 which may or may not have one or more handles 108 for ergonomic handling, and a flange (illustrated in FIG. 2) for mating with the docking station 103 and/or the slide cover 111. In one or more embodiments, the handle 108 may be positioned to balance a full load, near loaded container 107's center of gravity.

In one or more embodiments, as will be discussed in detail below with regard to FIG. 2, the container 107 has a bottom surface 117 and one or more side walls 119. For example, the container 107 may take any general shape so that it may have one side wall 119 in a case where a cross-section of the container 107 is rounded, or many side walls 119 in a case where a cross-section of the container 107 is polygonal. In the case of a polygonal cross-section, for example, such as that illustrated in FIG. 1, such a cross-section enables efficient pallet loading because multiple ink carriers 101 may be able to fit well on a conventional shipping/storage pallet.

In one or more embodiments, the container 107 has an opening (illustrated in FIG. 2) that is distal the bottom surface 117 through which the ink carrier dispenses its contents. In some embodiments, the opening may be of a size that is lesser in area that the bottom surface 117, or any cross-section taken of the container 107 through any sidewall 119. Accordingly, to accommodate the opening, the container 107 may have a neck portion 121 positioned between the bottom surface 117 and the opening. The neck portion 121 may be linearly sloped, for example, by having two or more asymmetrical sides that reduce the cross-sectional area of the container 107 as a distance from the bottom surface 117 increases. Alternatively, the neck portion 121 may be non-linearly sloped so that it is curved, for example. The sloping sides, whether asymmetrical and linear, or non-linear, enable dispensing the contents of the ink carrier 101 without plugging.

In one or more embodiments, the neck portion 121 facilitates an installation of the ink carrier 101 into the docking station 103. For example, docking station 103 may have a receiving portion 123 that is configured to receive an ink carrier 101 having a specific shape such as one having a neck portion 121 with two asymmetrical sides, one that is rounded to a specific diameter, etc. Accordingly, if an ink carrier 101 is not of the specific shape, it would be deemed incompatible with the docking station 103 and not allowed to be installed into the docking station 103.

As illustrated in FIG. 1, the container 107 has a docking side wall 125 that is generally flat from the bottom surface 117 to the opening and does not slope toward the opening in the same manner as the rest of the neck portion 121. However, it should be noted that in other embodiments, the docking side wall 125 may slope toward the opening, or have any feature, for example, that may act as a key to guide the ink carrier 101 into position on the docking station 103. For example, the neck portion 121 may have one or more tabs (illustrated in FIG. 2) that mate with one or more receiving features of the receiving portion 123 to guide the ink carrier 101 into position.

According to various embodiments, the ink carrier 101 may have an additional opening 127 in the neck portion 121, for example. The additional opening 127 may be used to fill the ink carrier 101 if it is assembled to have the slide cover 111 and/or the film seal 109 in place before filling.

In one or more embodiments, the film seal 109 protects the ink contained in the ink carrier 101 from environmental factors such as moisture, for example. The film seal 109 may be heat sealed or adhesively attached, for example, to a surface of the container 107 around the opening of the container 107. The film seal 109, which may be attached to the container 107 before or after filling the container 107, is positioned between one or more surfaces around the opening, such as a surface of the flange 205 (illustrated in FIG. 2) and the slide cover 111 when it is installed onto the ink carrier 101.

According to various embodiments, if the ink carrier 101 has the additional opening 127, the ink carrier 101 also has a plug 115 to close the opening 127. The plug 115 may be color coded so that it indicates a type and/or color of ink contained within the ink carrier 101. Because the plug 115 may be removed and replaced, the ink carrier 101 may be recycled to accommodate any type and/or color of ink, and as such, the plug 115 may be replaced to indicate the type and/or color of ink contained within the ink carrier 101.

In one or more embodiments, the ink carrier 101 also has a unit monitor 113 that stores information indicating the type and/or color of ink contained within the ink carrier 101. The unit monitor 113 may be any of a memory, a processor, or any combination thereof. The unit monitor 113 is configured to communicate with a processor that may be part of the docking station 103, or otherwise networked to the docking station 103 from a remote location. If the processor is remote from the docking station, then the unit monitor 113 may communicate with the processor by way of antenna 135, for example. Like the plug 115, the unit monitor 113 may be updated upon recycling of the ink carrier 101 to indicate any type and/or color of ink contained within the ink carrier 101.

According to various embodiments, the slide cover 111 is mated to the flange positioned about the opening and is movable between an open position and a closed position so that the ink carrier 101 retains the ink in the container 107 until the ink is to be dispensed into the barrel 105. The slide cover 111 is locked or latched in the closed position until the ink is to be dispensed to prevent it from being accidentally opened during transportation. In one or more embodiments, the slide cover 111 may optionally be moved to the open position by a user without the ink carrier 101 being mounted into the docking station 103. For example, if a user wanted to tamper with the ink, he may be allowed to do so. But, in some embodiments, to ensure security and prevent tampering, the slide cover 111 may be locked such that it is only movable when the ink carrier 101 is mounted into the docking station 103.

Regardless of whether the slide cover is movable only by way of the docking station 103 or by way of a user without the docking station, the slide cover 111 is allowed to be moved to the open position when the ink carrier 101 is installed into the docking station 103 and the unit monitor 113 facilitates a permission for the slide cover 111 to be moved to the open position. Permission for moving the slide cover 111 from the closed position to the open position may be granted based on a communication between the unit monitor 113 and the processor. For example, a printing system may have multiple system 100's affiliated with it. Each system 100 may be designated to distribute a particular type and/or color of ink to the printing system. Accordingly, if the barrel 105, for example, is designated to distribute magenta ink to the printing system, the processor would have knowledge of this information. Then, if an ink carrier 101 having a unit monitor 113 programmed to indicate that the content of the ink carrier 101 is magenta ink, a communication between the unit monitor 113 and the processor would take place granting permission for the ink carrier 101 to dispense its contents into the barrel 105. However, if the information provided by the unit monitor 113 is not a match for the type and/or color of ink expected to be dispensed into the barrel 105, then the contents are not allowed, or in other words, forbidden to be dispensed into the barrel 105.

According to various embodiments, the docking station 103 has a lockable handle 131 that may be manipulated by an operator or moved by a motor, for example, to move the slide cover 111 from its closed position to an open position. For example, once the ink carrier 101 is installed into the docking station 103, and permission is granted to dispense the ink into the barrel 105, the handle 131 is unlocked and allowed to move to cause the slide cover 111 to slide to the open position. In one or more embodiments, for example, the handle 131 may be in a locked state, and only allowed to be moved when permission is granted so as to cause the slide cover 111 to be moved from the closed position to the open position.

According to various embodiments, the slide cover 111 may optionally be replaced by a stationary cover. The stationary cover may be configured to be pierced by a piercing mechanism associated with the docking station 103 when the lockable handle 131 is granted permission to move from its locked position to another position to dispense ink into the barrel 105. In one or more embodiments, the cover, if pierceable, may comprise any material that may be permanently pierced, such as a polymer, metal or foil, for example. Or, the cover may comprise a material that is self healing such that when the ink carrier 101 is removed from the docking station 103, the cover may re-seal the opening to avoid spilling any remnant ink that has not been fully dispensed.

According to various embodiments, the unit monitor 113 and the processor may also facilitate a smart delivery of the ink contained in the ink carrier 101 on demand. For example, if the ink carrier 101 is installed into the docking station 103 when the barrel 105 is full, or un-needed, permission may not be granted to dispense the ink into the barrel 105 until the opportune time. For instance, it may be beneficial to keep the ink in the ink carrier 101 until it is necessary to fill the barrel 105 to avoid unnecessary introduction of moisture to the ink. Or, for example, an amount of ink that is dispensed may be controlled by the system 100 if, for example, the system 100 is configured to cause the slide cover 111 to move from the open position to the closed position before the contents of the ink carrier 101 are completely dispensed. In one or more embodiments, the system 100 may have a sensor associated with the barrel 105 to indicate an ink level in the barrel to ascertain whether ink is needed.

According to various embodiments, if the film seal 109 is present and fixed to the container 107, the film seal 109 may need to be removed from the ink carrier 101 to enable the ink to be dispensed into the barrel 105. The film seal, because it is heat sealed or adhesively attached to the container 107 may be easily removed when the slide cover 111 is in the open position. In one or more embodiments, the film seal 109 may have a tab or handle portion 133 that may be easily engaged by an operator for removal from the ink carrier 101 to cause the contents of the ink carrier 101 to empty into the barrel 105. Alternatively, the tab or handle portion 133 may be engaged by the handle 131 so that the film seal is pulled from the container 107 causing the contents of the ink carrier 101 to be emptied into the barrel 105 when the handle 131 causes the slide cover 111 to be moved from the closed position to the open position. In one or more embodiments, whether the film seal 109 has the tab or handle portion, the film seal may partially be removed from the container 107 when the slide cover 111 moves from the closed position to the open position, allowing or enabling the ink to be dispensed into the barrel 105.

In one or more embodiments, the film seal 109 may not be easily removable, or may be permanently sealed to the container 107. In one or more embodiments, the film seal 109 may be configured to be pierced by a piercing mechanism associated with the docking station 103 when the lockable handle 131 is granted permission to move from its locked position to another position to dispense ink into the barrel 105. The film seal 109, if pierceable, may comprise any material that may be permanently pierced, such as a polymer, metal or foil, for example. Or, the cover may comprise a material that is self healing such that when the ink carrier 101 is removed from the docking station 103, the cover may re-seal the opening to avoid spilling any remnant ink that has not been fully dispensed.

In one or more embodiments, after the ink is dispensed into the barrel 105, the slide cover 111 may be returned by the handle 131 to its closed position, where it is locked in place, so that any remnant ink that may still be in the ink carrier 101, for example, are not spilled when the ink carrier 101 is removed from the docking station 103.

In one or more embodiments, as discussed above, the container 107 may have one or more tabs 209 (illustrated in FIG. 2) that may serve as guides for positioning the ink carrier 101 into the docking station 103. The tabs may also be configured to engage features of the docking station 103 that interlock with the tabs to prevent the bottle from being removed while the system 100 is in the process of dispensing the ink contained in the ink carrier 101 and the slide cover 111 is in the open position. Alternatively, or in addition to the one or more tabs, the flange may be configured to mate with the docking station 103 by interlocking in place to prevent removal of the ink carrier 101 while the system 100 is in the process of dispensing the ink contained in the ink carrier 101.

Figure 2:
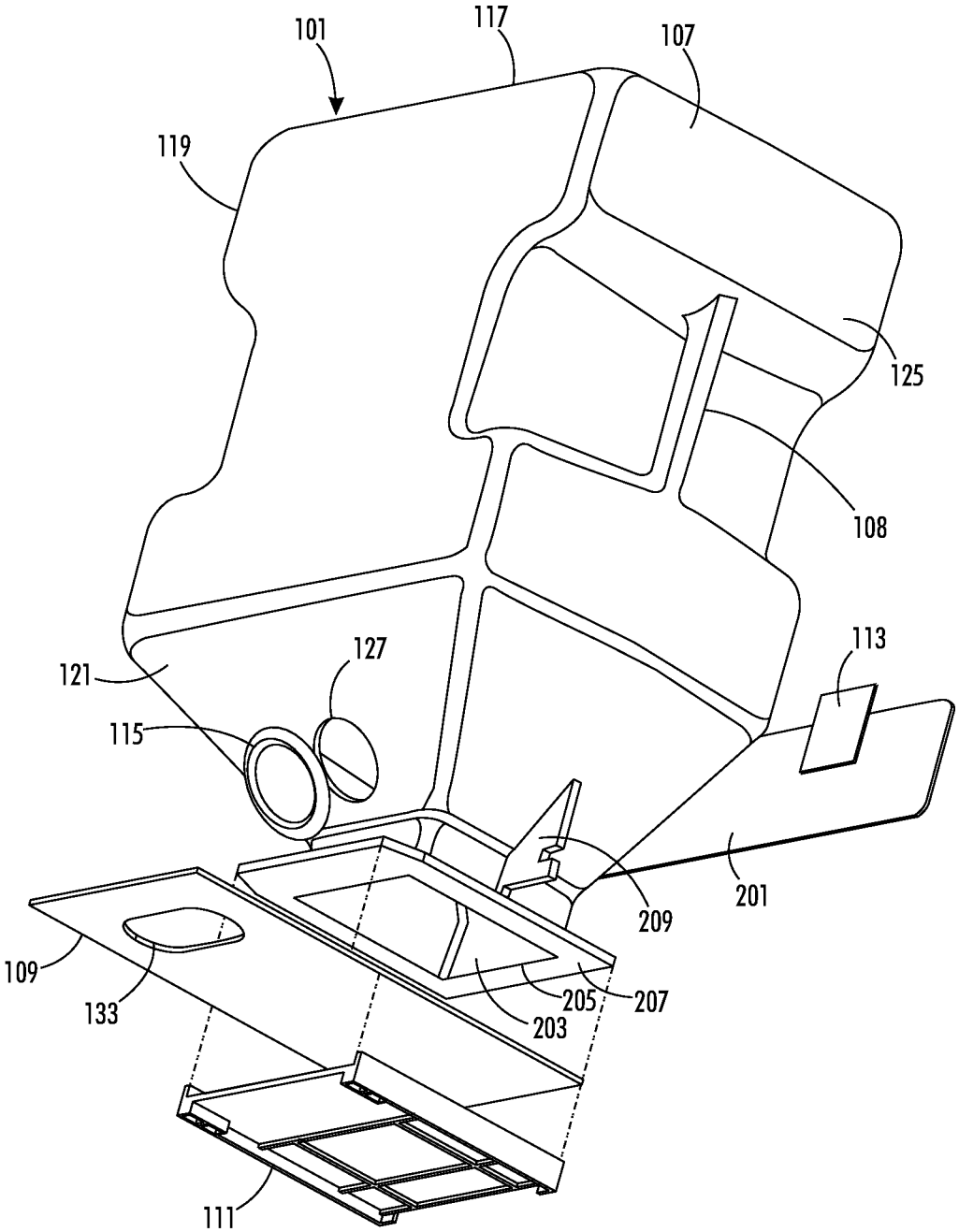
FIG. 2 is an exploded view of an ink carrying apparatus, according to one embodiment.

FIG. 2 is a perspective exploded view of the ink carrier 101, according to one example embodiment.

The ink carrier 101, as discussed above, includes a container 107, a film seal 109, a slide cover 111, a unit monitor 113, and a plug 115. The ink carrier 101, according to this example embodiment, also has a label 201 that indicates the type and/or color of ink contained in the ink carrier. The unit monitor 113 is positioned on the container 107 such that it is on the dispensing side wall 125 beneath the label 201.

The container 107, in this embodiment, has a handle 108, a bottom surface 117, one or more side walls 119, a neck portion 121, the dispensing side wall 125, and another opening 127 within which the plug 115 may be installed. The opening 127 may be a filler opening should the ink carrier require filling following assembly.

The container 107 also has an opening 203 through which the contents of the ink carrier 101 may be dispensed. The overall size of the opening enables easy flow of the contents of the ink carrier 101 for fast dispensing into the barrel 105.

According to various embodiments, the container 107 has a flange 205 that surrounds the opening 203. The flange 205, though illustrated as being polygonal, may take any shape or form such as a circle, oval, triangle, or any other shape. The flange 205 has a flange surface 207 on which the film seal 109 may be attached. The flange surface 207 may be rough or smooth, and may be flat, curved, undulating, or any other topography. The flange 205, as discussed above, may be configured to mate with the slide cover 111. When the slide cover 111 is in a closed position over the opening 203, the slide cover 111 is locked or latched in place. The slide cover 111 may be moved to an open position, and the film seal 109 removed, when the unit monitor 113 enables the slide cover to be moved by facilitating an unlocking of the handle 131. Or, the slide cover 111 may be movable when the ink carrier 101 is not installed into the docking station 103. When the slide cover 111 is moved, the film seal 109 may be removed from the ink carrier 101 by an operator, for example, that may grab the handle portion 133 of the film seal 109. Upon removal of the film seal 109, and after the contents of the ink carrier 101 have been dispensed, the slide cover 111 may be moved back to the closed and locked/latched position so that any remnant contents of the ink carrier 101 do not spill during removal from the docking station 103, discussed above.

In one or more embodiments, as discussed above, the container 107 may have a locking tab 209 that may be integrally formed with the container 107, or separately attached. The locking tab 209 may interlock with a locking feature of the docking station 103 so that the ink carrier 101 may not be removed from the docking station 103 while the ink carrier 101 is in the process of dispensing its contents. The flange 205 may also be configured to mate with the docking station 103 to prevent movement of the ink carrier 101 during the dispensing process.

Figure 3:
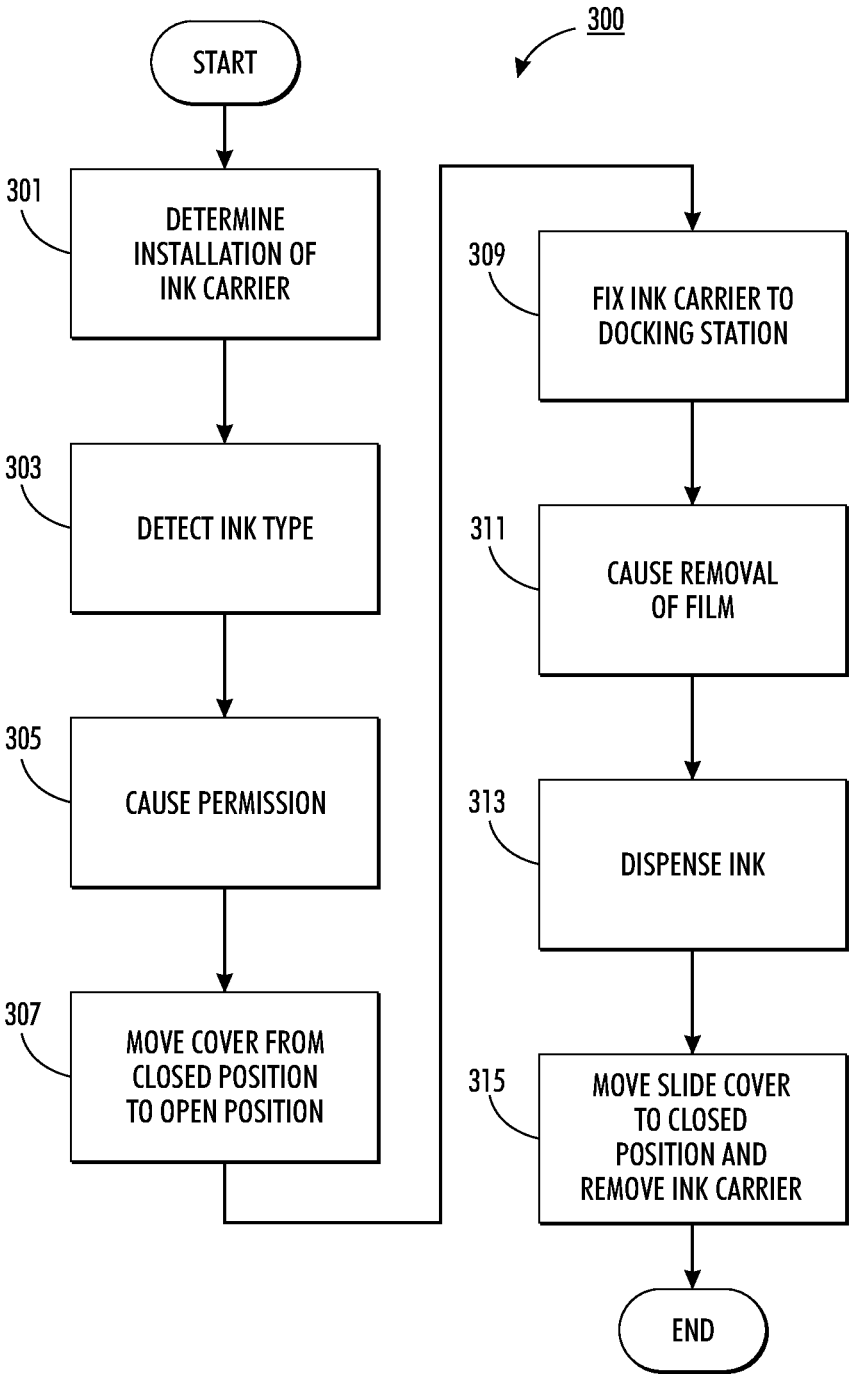
FIG. 3 is a flowchart of a process for selectively dispensing an ink useful in printing, according to one embodiment.
Figure 4:
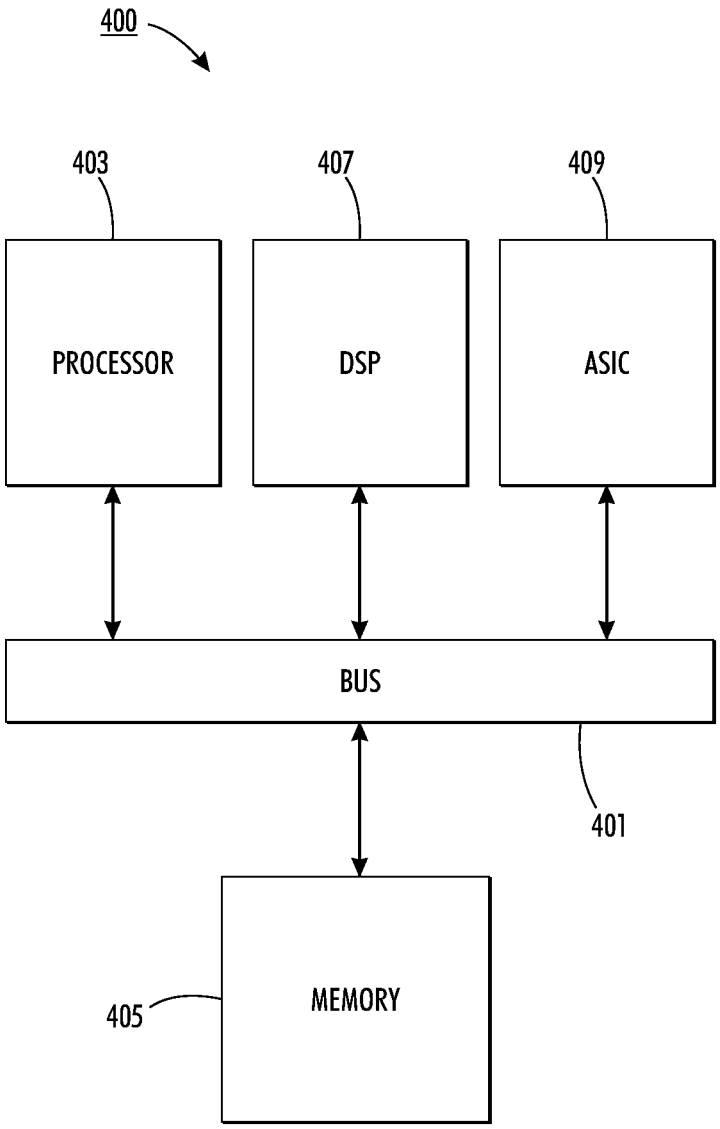
FIG. 4 is a diagram of a chip set that can be used to implement an embodiment of the invention.

FIG. 3 is a flowchart of a process for selectively dispensing an ink useful in printing, according to one embodiment. In one embodiment, the processor discussed above performs the process 300 and is implemented in, for instance, a chip set including a processor and a memory as shown in FIG. 4. In step 301, the processor determines an installation of the ink carrier 101 discussed above at the docking station 103. Then, in step 303, the processor causes, at least in part, a detection of a type of ink in the ink carrier 101 based, at least in part, on a communication between the processor and the unit monitor 113. Next, in step 305, the processor processes the detection of the type of ink to cause, at least in part, a permission to dispense the ink into the barrel 105 discussed above.

The process continues to step 307 in which the processor causes, at least in part, the slide cover 111 to be moved from a closed position to an open position based, at least in part, on the permission. In one or more embodiments, the movement is by way of handle 131. Then, in step 309, the processor causes, at least in part, the ink carrier 101 to be fixed to the docking station 103 when the slide cover 111 is in the open position by way of an interaction between the locking tab 209 and the docking station 103. Next, in step 311, the processor facilitates the film seal 109 to be removed when the slide cover 111 is in the open position by allowing the slide cover 111 to be moved to the open position. The film seal 109, as discussed above, may be removed by an operator, for example, or by the movement of the slide cover 111. The process continues to step 313 in which the ink is caused to be dispensed into the barrel 105 through the opening 203 when the slide cover 111 is in the open position and film seal 109 is removed. Then, in step 315, the slide cover 111 is moved to the closed position, the ink carrier 101 is unlocked from the docking station 103 and the ink carrier 101 is removed from the docking station 103 with the slide cover 111 in the closed position.

The processes described herein for selectively dispensing an ink useful in printing may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 4 illustrates a chip set or chip 400 upon which an embodiment may be implemented. Chip set 400 is programmed to selectively dispense an ink useful in printing as described herein may include, for example, bus 401, processor 403, memory 405, DSP 407 and ASIC 409 components.

The processor 403 and memory 405 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 400 can be implemented in a single chip. It is further contemplated that in certain embodiments the chip set or chip 400 can be implemented as a single "system on a chip." It is further contemplated that in certain embodiments a separate ASIC would not be used, for example, and that all relevant functions as disclosed herein would be performed by a processor or processors. Chip set or chip 400, or a portion thereof, constitutes a means for performing one or more steps of selectively dispensing an ink useful in printing.

In one or more embodiments, the chip set or chip 400 includes a communication mechanism such as bus 401 for passing information among the components of the chip set 400. Processor 403 has connectivity to the bus 401 to execute instructions and process information stored in, for example, a memory 405. The processor 403 may include one or more processing cores with each core configured to perform independently. A multi-core processor enables multiprocessing within a single physical package. Examples of a multi-core processor include two, four, eight, or greater numbers of processing cores. Alternatively or in addition, the processor 403 may include one or more microprocessors configured in tandem via the bus 401 to enable independent execution of instructions, pipelining, and multithreading. The processor 403 may also be accompanied with one or more specialized components to perform certain processing functions and tasks such as one or more digital signal processors (DSP) 407, or one or more application-specific integrated circuits (ASIC) 409. A DSP 407 typically is configured to process real-world signals (e.g., sound) in real time independently of the processor 403. Similarly, an ASIC 409 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 403 performs a set of operations on information as specified by computer program code related to selectively dispensing an ink useful in printing. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 401 and placing information on the bus 401. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 403, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 403 and accompanying components have connectivity to the memory 405 via the bus 401. The memory 405 may include one or more of dynamic memory (e.g., RAM, magnetic disk, writable optical disk, etc.) and static memory (e.g., ROM, CD-ROM, etc.) for storing executable instructions that when executed perform the inventive steps described herein to selectively dispense an ink useful in printing. The memory 405 also stores the data associated with or generated by the execution of the inventive steps.

In one or more embodiments, the memory 405, such as a random access memory (RAM) or any other dynamic storage device, stores information including processor instructions for selectively dispensing an ink useful in printing. Dynamic memory allows information stored therein to be changed by system 100. RAM allows a unit of information stored at a location called a memory address to be stored and retrieved independently of information at neighboring addresses. The memory 405 is also used by the processor 403 to store temporary values during execution of processor instructions. The memory 405 may also be a read only memory (ROM) or any other static storage device coupled to the bus 401 for storing static information, including instructions, that is not changed by the system 100. Some memory is composed of volatile storage that loses the information stored thereon when power is lost. The memory 405 may also be a non-volatile (persistent) storage device, such as a magnetic disk, optical disk or flash card, for storing information, including instructions, that persists even when the system 100 is turned off or otherwise loses power.

The term "computer-readable medium" as used herein refers to any medium that participates in providing information to processor 403, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. A system useful in printing configured to dispense an ink, the system comprising:

an ink carrying apparatus comprising:

a container comprising a bottom surface, an opening distal the bottom surface, and one or more sidewalls proximate the bottom surface, the one or more sidewalls being configured to form a neck portion positioned between the bottom surface, and a flange arranged about the opening;

a movable cover configured to mate with the flange so as to cover the opening in a closed position;

a unit monitor configured to facilitate a movement of the movable cover from the closed position to an open position;

a film positioned between one or more surfaces of the movable cover and one or more surfaces of the flange to seal the opening, the film being removable when the movable cover is in the open position; and a locking tab configured to restrict movement of the container when the movable cover is in the open position;

a docking station configured to accept the ink carrying apparatus and engage the locking tab when the movable cover is in the open position, the docking station being configured to attach to a storage drum such that the ink can flow from the ink carrying apparatus through the docking station and into the storage drum; and a processor configured to communicate with the unit monitor to facilitate the movement of the movable cover from the closed position to the open position, wherein based on a detection of a type of ink in the container that is based, at least in part, on a communication between the processor and the unit monitor, the movable cover is allowed to be moved from the closed position to the open position to facilitate removal of the film and cause the ink to be dispensed.

2. A system of claim 1, wherein the docking station comprises a lockable handle, the movable cover is further configured to mate with the lockable handle, and the movable cover is caused to move from the closed position to the open position by way of the lockable handle.

* * * * *